US006565373B2

(12) United States Patent
Cuevas

(10) Patent No.: US 6,565,373 B2
(45) Date of Patent: May 20, 2003

(54) ZIF SOCKET AND ACTUATOR FOR DIP

(75) Inventor: Peter Cuevas, Los Gatos, CA (US)

(73) Assignee: QualiTau, Inc., Santa Clara, CA (US)

( * ) Notice: Subject to any disclaimer, the term of this patent is extended or adjusted under 35 U.S.C. 154(b) by 0 days.

(21) Appl. No.: 10/160,303

(22) Filed: May 29, 2002

(65) Prior Publication Data

US 2003/0003790 A1 Jan. 2, 2003

Related U.S. Application Data

(60) Provisional application No. 60/301,518, filed on Jun. 27, 2001.

(51) Int. Cl.[7] ..... H01R 11/22
(52) U.S. Cl. ..... 439/266
(58) Field of Search ..... 439/266, 264, 439/259, 70, 71

(56) References Cited

U.S. PATENT DOCUMENTS 5,021,000 A * 6/1991 Scheibner ..... 439/342
6,179,640 B1 1/2001 Sikora et al.

* cited by examiner

*Primary Examiner*—Lynn D. Feild
*Assistant Examiner*—Phuong K T Dinh
(74) *Attorney, Agent, or Firm*—Townsend and Townsend and Crew LLP; Henry K. Woodward

(57) ABSTRACT

A socket for use in testing packaged integrated circuits having leads depending therefrom includes a first member for receiving the integrated package and having a plurality of first holes for receiving leads extending from the package. A second member has a plurality of wires for engaging the leads, each wire being anchored at ends to the second member with an intermediate portion engaging a lead. Each intermediate portion is aligned with a first hole and capable of being flexed out of alignment with the first hole for insertion of an integrated circuit package into the socket. The first member includes a second plurality of holes aligned with the wires of the second member, and an actuator has a plurality of pins arranged to extend into the second plurality of holes for engaging the plurality of wires and flexing the intermediate portions of the wires out of alignment with the first plurality of holes.

11 Claims, 6 Drawing Sheets

Actuator 2 mated with new ZIF socket, ready for actuation

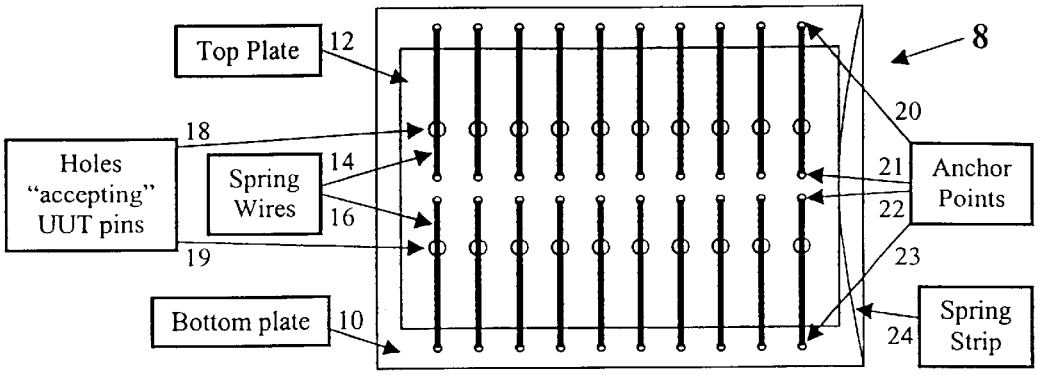
Fig. 1: Prior Art QualiTau ZIF Socket (Empty position)
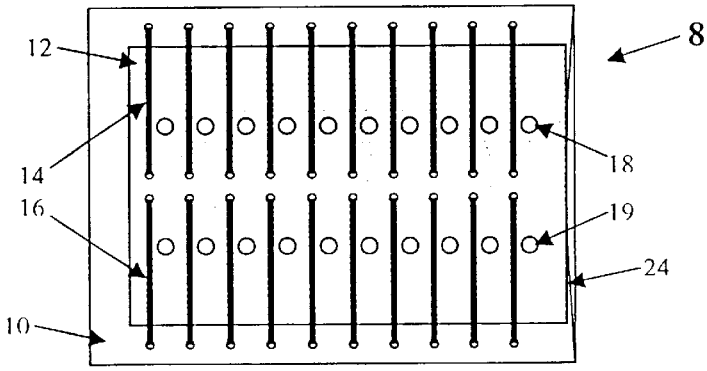
Fig. 2: Prior Art QualiTau ZIF Socket (Actuated position)
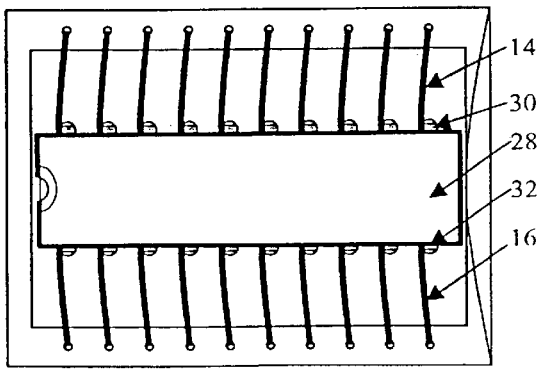
Fig. 3a: Engaged Position (UUT Body Shown)
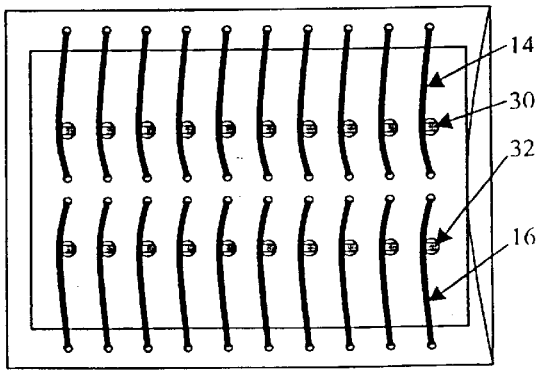
Fig. 3b: Engaged Position (UUT Body Not Shown)

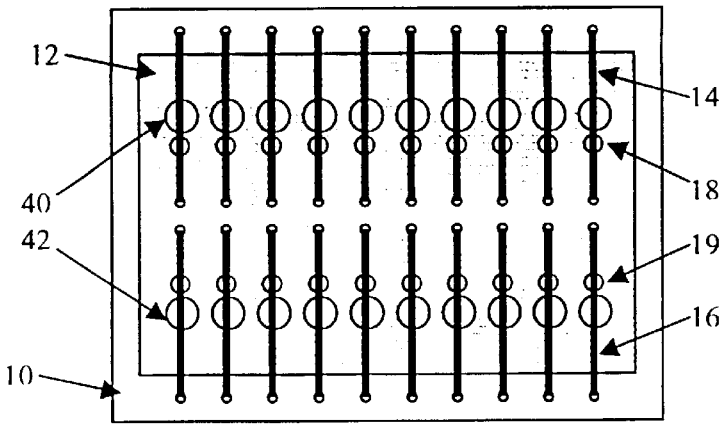
Fig. 4: Empty Position representation of the new ZIF socket
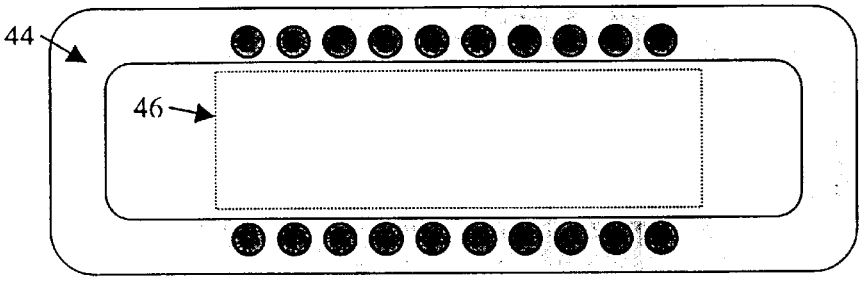
Fig. 5A: Top View of version 1 of "new" Actuating Mechanism
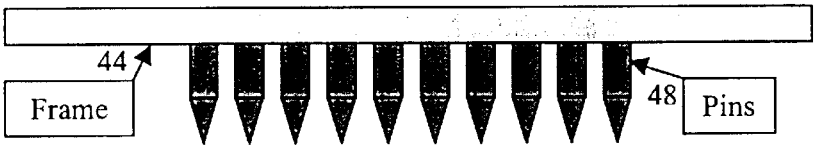
Fig. 5B: Side View of version 1 of "new" Actuating Mechanism
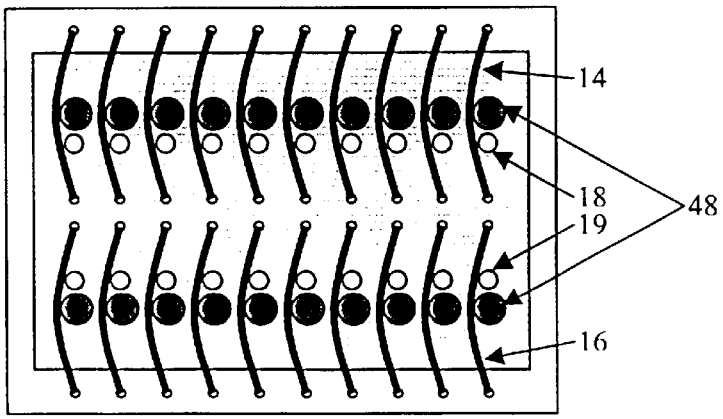
Fig. 6: Actuated Position – Actuator 1 mated with new ZIF socket

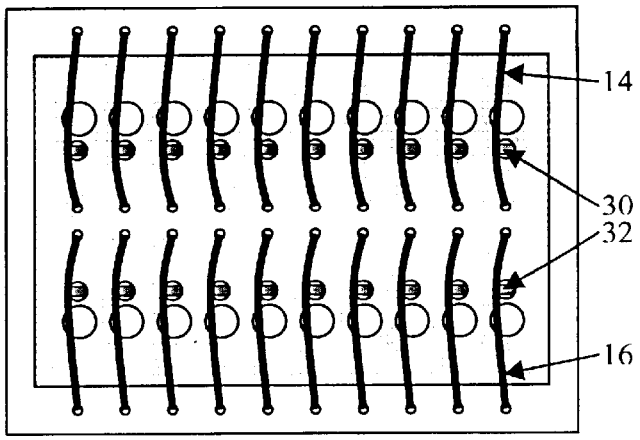
Fig. 7: Engaged Position – UUT mated with new ZIF socket and Actuator 1 removed
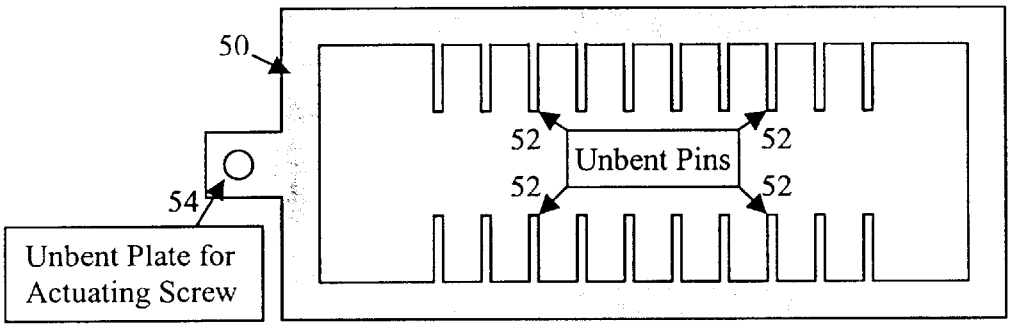
Fig. 8: Almost completed External Actuator 2
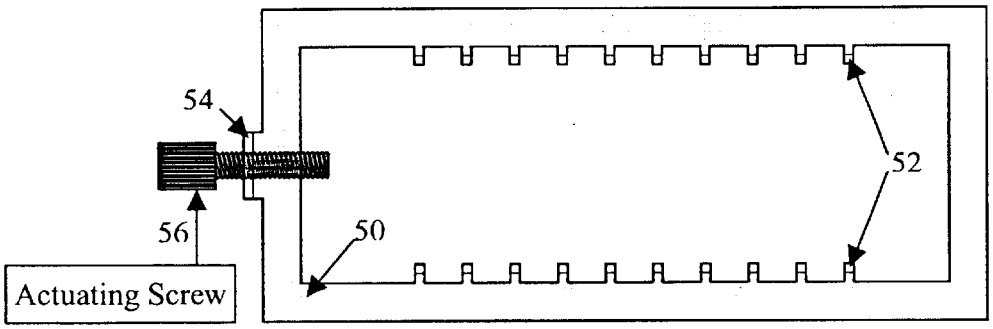
Fig. 9A: Top View of Actuator 2
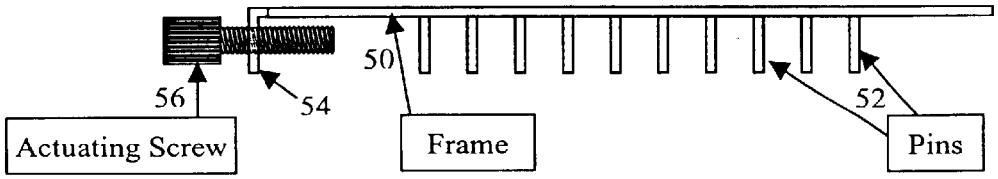
Fig. 9B: Side View of Actuator 2

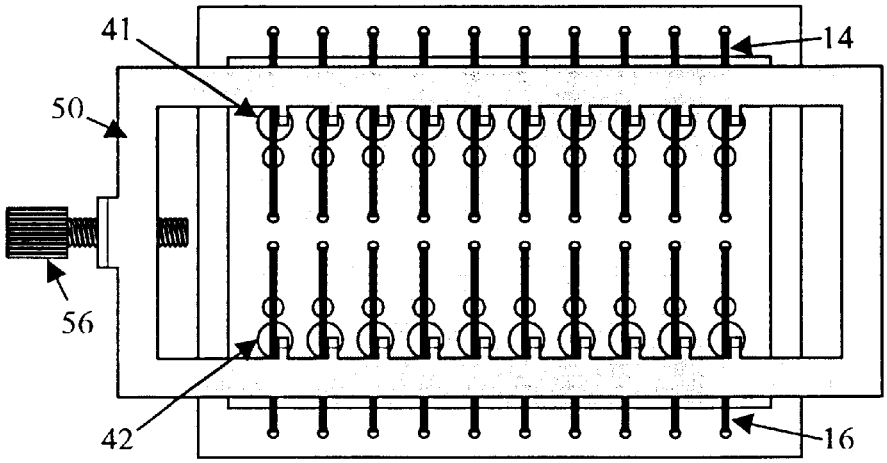
Fig. 10: Actuator 2 mated with new ZIF socket, ready for actuation
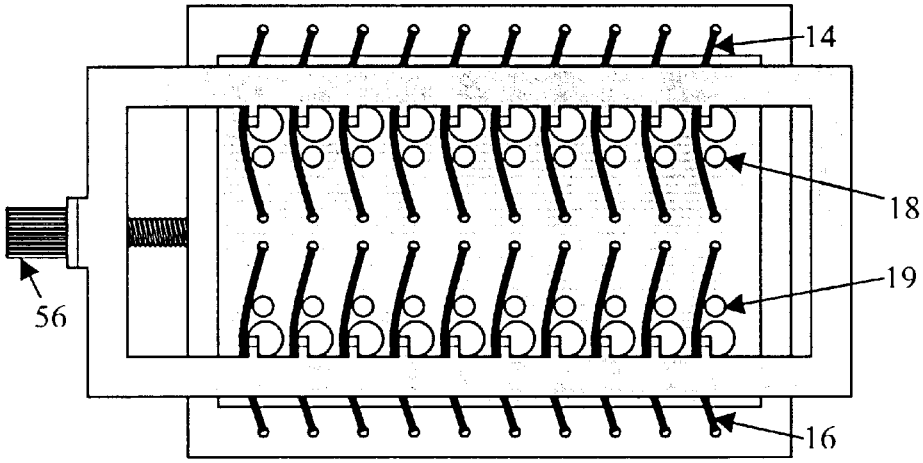
Fig. 11: Actuated Position using Actuator 2
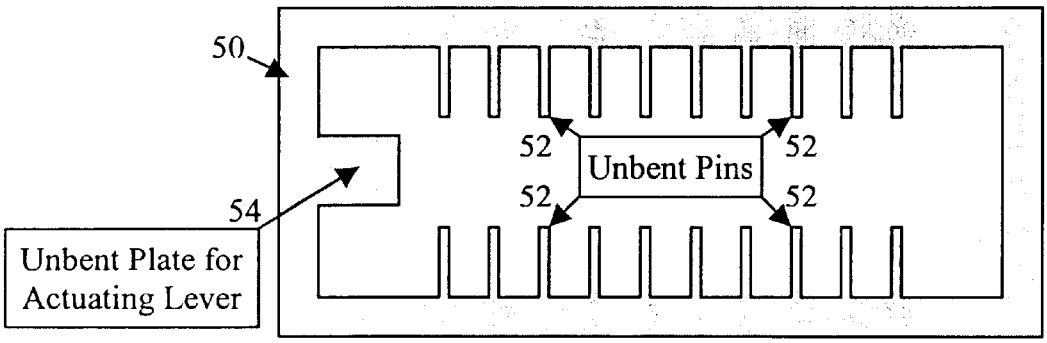
Fig. 12: Almost completed External Actuator 3

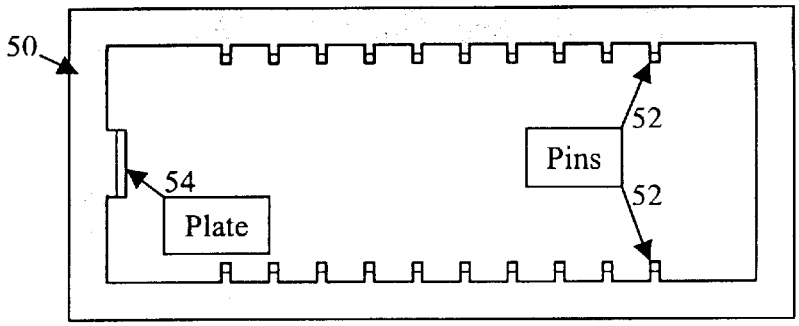
Fig. 13A Top View of Actuator 3 without the lever
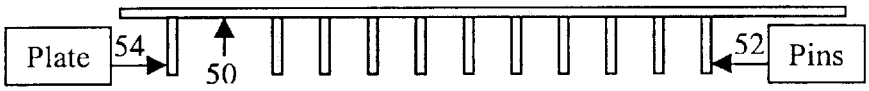
Fig. 13B: Side View of Actuator 3 without the lever
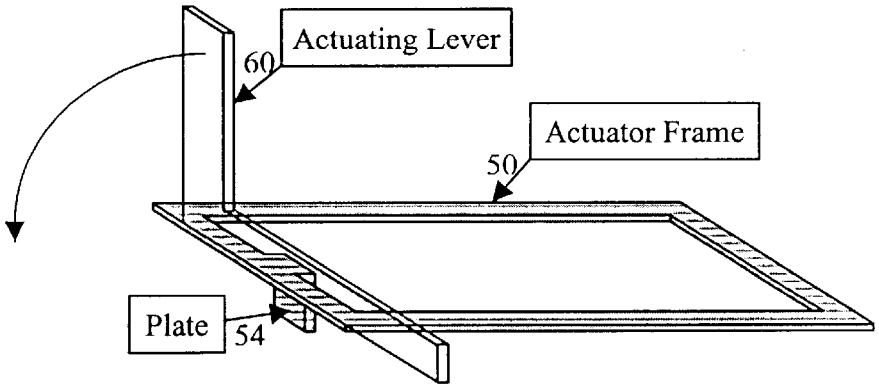
Fig. 14: Three-dimensional representation of Actuator 3 with Lever
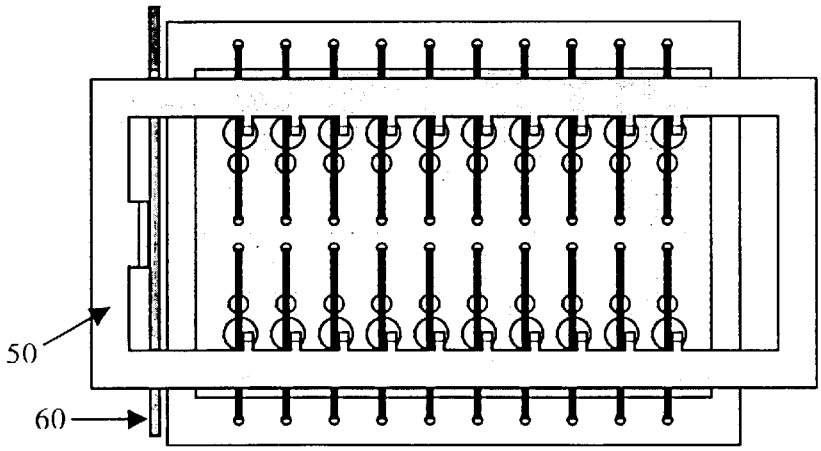
Fig. 15A: Actuator 3 with lever, placed into new ZIF socket, ready for actuation

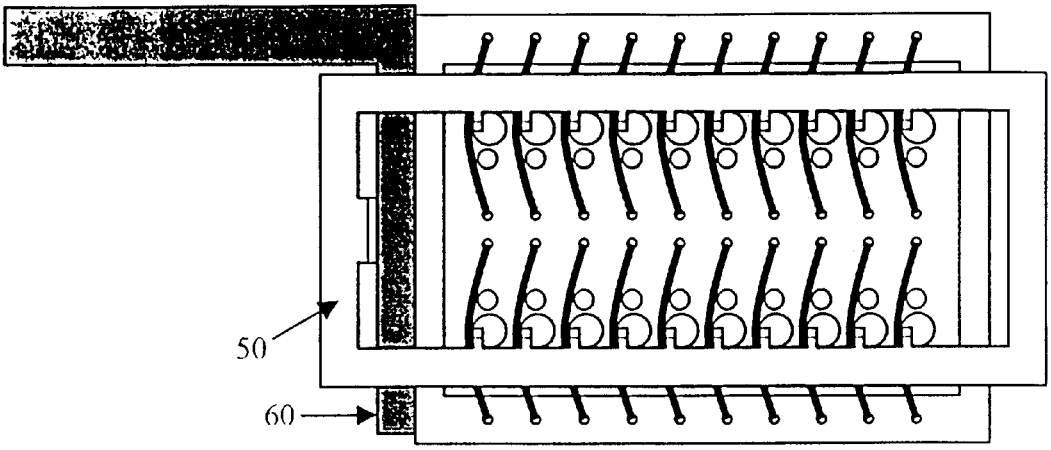
Fig. 15B: Actuated Position using Actuator 3
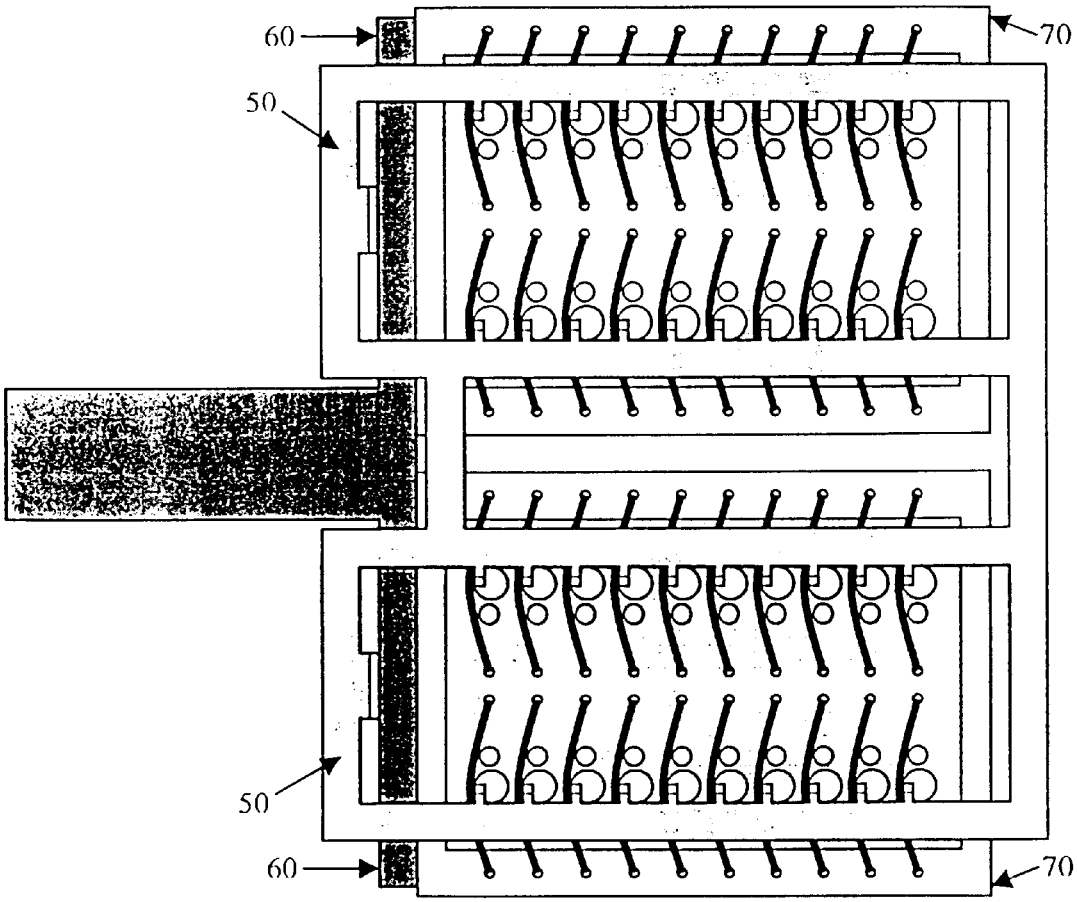
Fig. 16: A "double socket" version of Actuator 3

ZIF SOCKET AND ACTUATOR FOR DIP

CROSS-REFERENCES TO RELATED APPLICATIONS

This patent application claims the benefit of copending Provisional Application No. 60/301,518, filed Jun. 27, 2001, for HIGH TEMPERATURE MINIMAL (ZERO) INSERTION FORCE SOCKET WITH AN EXTERNAL ACTUATOR, and is related to U.S. Pat. No. 6,179,640 for HIGH TEMPERATURE MINIMAL (ZERO) INSERTION FORCE SOCKET assigned to the present assignee, which are incorporated herein by reference for all purposes.

BACKGROUND OF THE INVENTION

This invention relates generally to the testing of electrical integrated circuits, and more particularly the invention relates to sockets for receiving packaged integrated circuits for test purposes.

The packaged integrated circuit typically includes a polymer or ceramic housing for a semiconductor chip with electrical leads extending from the package which are electrically connected to the semiconductor chip. In a dual in-line package (DIP), the electrical leads are arranged in two parallel rows with the leads depending from the bottom of the housing.

Packaged integrated circuits must undergo a number of different tests, each test requiring the insertion of the integrated circuit package and leads into a test socket. To prevent bending or damage to the leads, zero insertion force (ZIF) sockets have been devised to limit the force exerted on the leads when the package is inserted into a test socket. The most widely known and used ZIF sockets are from 3M Corporation and Aries Corporation. In these sockets the leads of a DIP (dual in-line package) are pinched between two pieces of metal which are, in turn, soldered to a printed circuit board. The metal pieces are held in place by the body of the ZIF socket which is typically made of plastic. The metal pieces are electrically conducting to provide a good electrical path from the DIP lead to the printed circuit board in which the ZIF socket is attached. In all cases, the bodies of these sockets are made of some organic material (plastics or polymers) which can only withstand temperatures as high as 250° C. for extended periods of time. The metal used to pinch the leads of the IC DIP packages are beryllium copper alloy or beryllium nickel alloy for a high temperature operation not to exceed 250° C. While these sockets perform well within their stated specifications, they cannot be used at temperatures in excess of 250° C. because the materials will decompose and fail.

FIG. 1 is a top view of the '640 patent socket in an empty position. The socket 8 includes a bottom plate 10 and a top plate 12 (shown by outline) with the lower plate including two arrays of parallel wires 14, 16 which are respectively anchored to bottom plate 10 in holes at anchor points 20, 21 and anchor points 22, 23. Top plate 12 includes two rows of holes 18, 19 for receiving pins of a dual inline pin (DIP) package. A yieldable metal spring 24 maintains top plate 12 positioned on bottom plate 10 with wires 14, 16 centrally disposed over holes 18, 19. The bottom plate has elongated slots (not shown) through which package pins extend. In this socket design, the bottom plate is fixed, while the top plate is made laterally translatable with respect to the bottom plate by means of a cam drive.

FIG. 2 shows the socket in an actuated position with the top plate moved laterally to the right against spring 24 with holes 18, 19 moved from wires 14, 16. In this position the Unit Under Test (UUT) pins can be placed in the holes or withdrawn from the holes without the wires obstructing the pins. Once pins are inserted in the holes, and the actuating force is removed, spring 24 will then push the top plate to the left whereby the pins engage wires 14, 16.

FIGS. 3A, 3B show UUT 28 positioned in the socket with pins 30, 32 engaging wires 14, 16. In FIG. 3B UUT 28 is removed to expose the underlying interaction between the pins 30, 32 and wires 14, 16.

The present invention is directed to such a ZIF socket, but in which the top and bottom plates are fixed and a wire actuator is employed for inserting and removing a UUT.

BRIEF SUMMARY OF THE INVENTION

In accordance with the invention, a ZIF socket has top and bottom plates which are attached in a unitary structure, and an external wire actuator is employed for inserting and removing a UUT. The top plate has first and second rows of holes for receiving UUT pins with the holes aligned with the contact wires. Larger third and fourth rows of holes are provided for receiving pins of the actuator which engage and laterally flex the wires for inserting and removing a UUT.

In one embodiment, the actuator comprises a rectangular-shaped body with an open central portion through which a UUT package can pass. The body has two rows of pins depending therefrom for insertion into the third and fourth rows of holes in the socket and engaging the wire contacts. Each pin of the actuator preferably has a tapered point for facilitating the engagement with a wire contact.

In another embodiment, the actuator comprises a frame with depending pins which are received in the third and fourth rows of holes. The frame is laterally translatable by means of a screw or lever, for example, whereby the depending pins can engage and flex the wires for inserting and removing a UUT.

By using a wire actuator in accordance with the invention, the ZIF socket has a simplified design and can be more economically manufactured.

The invention and objects and features thereof will be more readily apparent from the following detailed description and appended claims when taken with the drawings.

BRIEF DESCRIPTION OF THE DRAWINGS

FIGS. 1, 2 are plan views of a ZIF socket in accordance with the prior art in an empty position and in an actuated position, respectively.

FIGS. 3A, 3B illustrate the ZIF socket of FIGS. 1, 2 with a unit under test inserted therein.

FIG. 4 is a plan view of a ZIF package in accordance with one embodiment of the invention.

FIGS. 5A, 5B are a top view and side view of a wire actuator for use with the socket of FIG. 4 in accordance with one embodiment of the invention.

FIGS. 6, 7 illustrate the socket of FIG. 4 with the actuator of FIG. 5 inserted therein for the insertion of a UUT, and with the actuator removed and wire contacts engaging pins of the UUT, respectively.

FIG. 8 is a plan view of a frame actuator in accordance with another embodiment of the invention.

FIGS. 9A, 9B are a plan view and a side view of the actuator of FIG. 8 after forming the wire-actuating pins and the actuating screw plate.

FIGS. 10, 11 illustrate a ZIF socket with the actuator of FIGS. 8, 9 before and after wire actuation.

FIG. 12 is a plan view of a frame actuator in accordance with another embodiment of the invention prior to forming of the actuating pins.

FIGS. 13A, 13B are a plan view and side view of the frame actuator of FIG. 12 after forming of the wire actuating pins and lever plate.

FIG. 14 is a perspective view of the actuator of FIGS. 12, 13 with an actuating lever.

FIGS. 15A, 15B are plan views of the actuator of FIGS. 12–14 prior to wire actuation and after wire actuation, respectively.

FIG. 16 is a plan view of another embodiment of a wire actuator for use with a plurality of ZIF packages in accordance with an embodiment of the invention.

Like elements in the several views have the same reference numerals.

DETAILED DESCRIPTION OF THE INVENTION

FIG. 4 is a plan view of a ZIF socket in accordance with one embodiment of the invention. Again, a bottom plate 10 supports contact wires 14, 16, and top plate 12 has contact holes 18, 19 for receiving pins of a UUT. In accordance with this embodiment, top plate 12 further includes two rows of holes 40, 42 with each of the holes being larger than the contact holes 18, 19. In this embodiment, the contact wires 14, 16 between top plate 12 and bottom plate 10 are slightly offset from the center of holes 40, 42 for receiving an actuating mechanism, shown in FIG. 5. Since there is no need for the top plate to move laterally with respect to the bottom plate, the two plates can be joined together for comprising a unitary structure, and the cam actuation mechanism in accordance with the prior art is eliminated.

FIGS. 5A, 5B are a plan view and side view, respectively, of an actuator for use with the socket of FIG. 4. The actuator comprises a body 44 having a central opening through which a UUT 46 (shown by dotted lines) can be inserted. Body 44 includes a plurality of pins 48 which mate with holes 40, 42 of the socket of FIG. 4. Preferably, the tips of pins 48 are tapered to a point to facilitate insertion in holes 40, 42 and engagement with wires 14, 16.

FIG. 6 is a plan view illustrating the socket of FIG. 4 with pins 48 inserted in holes 40, 42 which deflect wires 14, 16 away from holes 18, 19 thereby allowing the insertion of a UUT or removal of a UUT from the socket. To facilitate the illustration of the deflecting wires, body portion 44 of the actuator is not shown. As seen, the actuator pins effectively push the center portion of the wires enough to the left so that the wires are no longer over the holes 18, 19 for the UUT pins. The wires are consistently forced to move to the left rather than to the right as long as there is some sufficient actuator offset of the wires over holes 40, 42. The magnitude of the wire movement as effected by the actuator pins is a function of both the actuator offset and the diameter of the actuator pins.

FIG. 7 is a plan view showing the ZIF socket with the wires 14, 16 engaging pins 30, 32 of a UUT. This position is attained when the actuator is removed while the UUT is mated to the ZIF socket. Again, the body of the UUT is removed from view to expose the underlying interaction between the UUT pins 30, 32 and the ZIF socket wires 14, 16.

FIG. 8 is a plan view of a frame for an actuator in accordance with another embodiment of the invention. The frame 50 cut from a thin sheet of stainless steel, for example, includes a plurality of unbent pins 52 and an unbent screw plate 54 for an actuating screw. FIGS. 9A, 9B are a plan view and a side view, respectively, of the actuator of FIG. 8 after the screwplate 54 and pins 52 have been bent 90 degrees, and an actuating screw 56 is placed in a tapped hole in screwplate 54. In this embodiment, the ends of the pins 52 are blunt and this eliminates the sharper pins in the actuator of FIG. 5. Further, since the actuator is cut from a thin sheet of stainless steel, which can be placed over the top plate of the socket, the actuator presents less of an obstruction for the placement or removal of the UUT.

FIGS. 10 and 11 illustrate application of the actuator of FIG. 9 on the ZIF socket of FIG. 4. It would be noted that the actuator pins are sized small enough to slip into the large holes 41, 42 in the socket without being impeded by contact wires 14, 16. Hence, the placement of the actuator is itself a zero insertion force (ZIF) event. In FIG. 11, screw 56 engages the socket and forces the actuator pins against wires 14, 16 thereby clearing contact holes 18, 19 for receipt of the UUT pins. Once a UUT is placed in the socket, the actuating screw is unscrewed to its original position and the actuator is removed from the ZIF socket.

FIG. 12 is a plan view of another frame actuator which is similar to the actuator of FIG. 8 and has the same reference numerals. However, in this embodiment plate 54 is placed inside of body 50 for closer placement to the ZIF socket, as illustrated in the plan view and side view of the actuator in FIGS. 13A and 13B after bending of pins 52 and plate 54.

FIG. 14 is a perspective view of the actuator of the FIG. 12 with a cooperating lever 60 which is positioned between plate 54 and the ZIF socket (not shown). In this view, actuator pins 52 are not shown for simplification of the drawing. Lever 60 is shown in its position prior to actuation motion with the arrow indicating the rotational path of lever arm 60 to arrive at an actuated position.

FIGS. 15A, 15B are plan views of actuator 50 on a ZIF socket illustrating lever 60 prior to actuation and after actuation, respectively. The actuator is identical in function to the actuator of FIGS. 10, 11 except lever 60 effects the motion of the actuator rather than a screw.

Another advantage of the ZIF socket and actuator in accordance with the invention lies in the use of one actuator for a plurality of sockets, as illustrated in the embodiment of FIG. 16. Here the actuator is similar to the lever actuator of FIG. 14 with a single actuator 60 functioning with a plurality of sockets 70. In the area of reliability testing where statistics play a major role, several hundreds of UUTs may be tested at the same time, usually having an array of sockets mounted on a UUT board and using many such boards. In this situation, instead of having a multiplicity of complex and expensive ZIF sockets, the socket and actuator in accordance with the invention allows for the implementation of a much more cost effective alternative. Each person responsible for loading and unloading UUTs would need the use of only one or a small number of external actuators, thereby reducing the cost of the ZIF sockets and actuators and facilitating the use thereof by operators. While FIG. 16 illustrates the lever mechanism 60 actuating two sockets at the same time, it will be appreciated that a larger number of sockets could be actuated by a single lever.

The ZIF socket and actuator in accordance with the present invention simplifies the design of the socket, reduces cost, and facilitates use thereof by human operators in testing integrated circuit packages. While the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A socket and actuator for use in testing a packaged integrated circuit having a plurality of leads extending therefrom, said socket comprising:

a) a first member for receiving an integrated circuit package and having a first plurality of holes for receiving leads extending from the package, b) a second member having a plurality of wires for engaging leads extending through the first plurality of holes of the first member, each wire being anchored at ends to the second member with an intermediate portion engaging a lead, each intermediate portion being aligned with a hole and capable of being flexed out of alignment with the hole for insertion of an integrated circuit package into the socket, c) the first member including a second plurality of holes aligned with the wires of the second member, and d) an actuator having a plurality of pins arranged to extend into the second plurality of holes for engaging the plurality of wires and flexing the intermediate portions of the wires out of alignment with the first plurality of holes.

2. The socket and actuator as defined by claim 1 wherein the actuator comprises a body having a central opening for the passage of an integrated circuit package and a plurality of pins having tapered ends for insertion into the second plurality of holes and engaging the plurality of wires.

3. The socket and actuator as defined by claim 1 wherein the actuator comprises a body having a central opening for passage of an integrated circuit package and a plurality of pins for insertion into the second plurality of holes, the body being laterally translated whereby the plurality of pins engage the plurality of wires.

4. The socket and actuator as defined by claim 3 wherein the actuator further includes means for translating the body.

5. The socket and actuator as defined by claim 4 wherein the means for translating the body includes a plate depending from the body and a screw extending through the plate for engaging the second member.

6. The socket and actuator as defined by claim 4 wherein the means for translating the body includes a lever positioned between the body and the second member.

7. The socket and actuator as defined by claim 6 wherein the body includes a depending plate which is engaged by the lever.

8. The socket and actuator as defined by claim 3 wherein the body is formed from a metal plate.

9. The socket and actuator as defined by claim 1 wherein the first member and the second member are fastened together as a unitary structure.

10. The socket and actuator as defined by claim 1 wherein the packaged integrated circuit comprises a DIP package and the package requires minimal insertion force.

11. The socket and actuator as defined by claim 1 wherein the actuator is shared with other sockets.

* * * * *

UNITED STATES PATENT AND TRADEMARK OFFICE

CERTIFICATE OF CORRECTION

PATENT NO. : 6,565,373 B2
DATED : May 20, 2003
INVENTOR(S) : Peter Cuevas

It is certified that error appears in the above-identified patent and that said Letters Patent is hereby corrected as shown below:

Title page,
Item [54], replace "ZIF SOCKET AND ACTUATOR FOR DIP" and replace with the following: -- ZIF SOCKET AND ACTUATOR FOR DIP PACKAGE --

Signed and Sealed this

Sixteenth Day of December, 2003

JAMES E. ROGAN
*Director of the United States Patent and Trademark Office*